United States Patent [19]

Shimoma et al.

[11] Patent Number: 5,059,858

[45] Date of Patent: Oct. 22, 1991

[54] COLOR CATHODE RAY TUBE APPARATUS

[75] Inventors: Taketoshi Shimoma, Isesaki; Eiji Kamohara; Jiro Shimokobe, both of Fukaya, all of Japan

[73] Assignee: Kabushiki Kaisha Toshiba, Kawasaki, Japan

[21] Appl. No.: 603,153

[22] Filed: Oct. 25, 1990

[30] Foreign Application Priority Data

Oct. 27, 1989 [JP] Japan ..... 1-278567

[51] Int. Cl.[5] ..... H01J 29/70

[52] U.S. Cl. ..... 313/440; 335/210; 358/248

[58] Field of Search ..... 313/440, 477 R; 335/210, 213; 358/248, 249

[56] References Cited

U.S. PATENT DOCUMENTS 2,860,329 11/1958 Reiches ..... 358/248
3,895,329 7/1975 Logan et al. ..... 335/210

FOREIGN PATENT DOCUMENTS 58-32455 7/1983 Japan .
61-188841 2/1985 Japan .
61-288353 6/1985 Japan .
63-207035 2/1987 Japan .

*Primary Examiner*—Donald J. Yusko
*Assistant Examiner*—Ashok Patel
*Attorney, Agent, or Firm*—Cushman, Darby & Cushman

[57] ABSTRACT

In a color cathode ray tube apparatus of this invention, if an outer diameter of a neck having a cylindrical shape is represented by $D_N$ and an interval of adjacent electron beams at a screen-side end portion of an electron gun is represented by Sg, a value $D_N/Sg$ is 8.0 or more. A deflection means has a saddle-type horizontal deflection coil for deflecting electron beams in an in-line direction. If the length of the deflection means in a direction of the tube axis is represented by $l_H$all, $l_H$all is 90 mm or more.

6 Claims, 6 Drawing Sheets

COLOR CATHODE RAY TUBE APPARATUS

BACKGROUND OF THE INVENTION

1. Field of the Invention

The present invention relates to a color cathode ray tube apparatus and, more particularly, to a general high-image quality color cathode ray tube apparatus for an EDTV or HDTV.

2. Description of the Related Art

A general color cathode ray tube apparatus having high image quality comprises a tube provided with a panel, a funnel contiguous with the panel, and a cylindrical neck connected to the funnel. A shadow mask is arranged inside the panel, and a phosphor screen surface comprising a tri-color light emitting layer is formed on the inner surface of the panel to oppose the shadow mask. A large number of apertures are formed in the shadow mask. The shadow mask has a frame on its periphery, and is supported on the panel through the frame. An internal magnetic shield is mounted on the frame. An internal conductive film is coated from the inner wall of the funnel to a portion of the neck. An external conductive film is coated on the outer wall of the funnel, and an anode electrode is provided to a portion of the funnel. An electron gun for outputting three electron beams is accommodated in the neck. A deflection device is arranged outside a boundary portion between a cone portion of the funnel and the neck so as to deflect three electron beams emerging from the electron gun in horizontal and vertical directions. In addition, a driver for applying an appropriate voltage to the electron gun and the anode electrode and supplying a voltage to the deflection device is arranged.

Red, green, and blue phosphor stripes or dots are distributed and coated on the phosphor screen surface. Three electron beams Br, Bg, and Bb emerging from the electron gun toward the phosphor screen surface are deflected by the deflection device. The electron beams Br, Bg, and Bb are selected by the shadow mask, and then become incident on the phosphor screen. Thus, the corresponding phosphors emit light to form an image. In an electron gun having an in-line arrangement, three parallel electron beams are generated. This electron gun has an electron beam forming unit GE for generating, controlling, and accelerating three electron beams, and a main electron lens unit ML for focusing and converging these electron beams.

A deflection yoke as the deflection device has horizontal and vertical deflection coils for deflecting the three electron beams in the horizontal and vertical directions. In the deflection yoke for deflecting in-line aligned electron beams, in order to precisely converge electron beams, a horizontal deflection magnetic field is formed into a pin-cushion pattern, and a vertical deflection magnetic field is formed into a barrel pattern, thus constituting a so-called convergence free system.

In order to correct a coma in convergence, a deflection magnetic field control element formed of a ferromagnetic material is arranged on a portion of the electron gun near the phosphor screen. In a color cathode ray tube apparatus, along with improvements in stress analysis in the tube, and in manufacturing techniques of large-size tubes and explosion proof bands, ultra-large-size tubes having screen diagonal diameters of 30" to 40" have been increasingly popular. Since an ultra-large-size tube inevitably has a large depth, a deflection angle of electron beams is set to be 100° to 110° to shorten the depth as much as possible. In this situation, high-image quality television broadcast systems have been developed. For example, an EDTV (clear vision) or an HDTV (high-vision or high-definition television) requires a high-image quality color cathode ray tube apparatus. That is, the following improvements in quality are required:

(1) a thermal countermeasure against heat generation of a deflection device since a deflection frequency is increased;

(2) an improvement in distortion of a beam spot on a peripheral portion of a screen; and (3) an improvement in convergence characteristics of three electron beams on a peripheral portion of a screen.

Heat generation of a deflection device used in a conventional broadcast system reaches at most 30° C. or less, and no problem is posed. In an EDTV or HDTV, however, since a horizontal deflection frequency is as high as 30 kHz or higher, losses caused by an eddy current due to a horizontal deflection magnetic field are increased. For this reason, a heat generation amount of the deflection device is considerably increased. Since an anode voltage is increased from 25 to 28 kV (conventional device) to 29 to 34 kV to attain a high luminance, this leads to an increase in deflection current for deflecting electron beams. Therefore the number of heat generation factors of the deflection device is increased. For example, when an anode voltage of 32 kV and a horizontal deflection frequency of 33.8 kHz are applied to a conventional deflection device to perform 110% scan, the temperature of the deflection device is increased beyond 60° C., and the device is burnt.

Since this is a fatal drawback of a color cathode ray tube apparatus, some countermeasures against heat generation of the deflection devices are taken as follows:

(1) to improve a wire material (e.g., use a litz wire);

(2) to reduce a core heat generation amount using a core material having a small loss;

(3) to attain a high heat resistance of a deflection yoke material;

(4) to increase a deflection sensitivity to decrease a deflection current; and (5) to increase a deflection coil in size to improve heat radiation efficiency.

Although a conventional deflection device has already employed a large deflection coil proposed in item (5), when the size of the deflection coil is increased too much, an average coil diameter of the deflection coil is increased, and a deflection sensitivity is decreased. This cannot attain any improvement. In order to increase the size of the deflection device without increasing the average coil diameter, the deflection coil must be extended toward an electron gun. In a color cathode ray tube apparatus having such an arrangement, electron beams are undesirably deflected by the deflection device to land on the neck. For this reason, a neck shadow phenomenon occurs, i.e., the electron beams cannot reach the phosphor screen. That is, it is difficult to increase the size of the deflection yoke without decreasing its sensitivity. Countermeasures against heat generation of the deflection device can be taken by employing a litz wire, a small-loss core material, and a high-heat resistance material. However, these materials inevitably result in an increase in cost, and such a product is too expensive to be used as a home color cathode ray tube apparatus. Even if these countermeasures are taken, since electron beams are deflected through 110° at a horizontal deflection frequency of 40 kHz or higher in a European HDTV or in a high-definition TV system for computer graphics, a heat generation amount of the deflection device is considerably increased. As described above, heat generation of the deflection device poses an important problem in a color cathode ray tube apparatus for an EDTV or HDTV.

The next problem in a color cathode ray tube apparatus for a high-definition TV system such as an EDTV or HDTV is a decrease in resolution on a peripheral portion of the screen.

This problem is caused by an influence of a deflection magnetic field, and an influence of a difference between distances of electron beam paths on the central and peripheral portions of the screen. Under these influences, the resolution is decreased due to a so-called deflection defocus (i.e., a distorted beam spot) and a convergence offset of three electron beams on the peripheral portion of the screen. Such a decrease in resolution becomes conspicuous with an increase in size or deflection angle of a tube and a decrease in profile of a panel. When such a color cathode ray tube apparatus is applied to a high-definition TV system such as an EDTV or HDTV, the above-mentioned problems become worse.

As a countermeasure against the deflection defocus, a method of improving an electron gun and a method of improving a deflection device are known. Conventionally, an improvement in an electron gun is more effective than an improvement in a deflection device, and e.g., a dynamic focus method is available. In this method, a power of an electron lens of an electron gun is changed in synchronism with a deflection state of electron beams to correct a distortion of a beam spot. With this method, the distortion of the beam spot on the peripheral portion of the screen is remarkably improved. However, another problem is posed. That is, since the power of the electron lens is changed in synchronism with a deflection state of the electron beams, a voltage which is changed over about 1 kV or more in synchronism with the deflection state must be supplied. For this reason, cost of the color cathode ray tube apparatus is considerably increased. In order to correct a spot distortion of electron beams without increasing cost, not the electron gun but the deflection device is improved. In this improvement, a deflection magnetic field is changed to correct the distortion of the beam spot.

A method of controlling a deflection magnetic field will be described below. A beam spot is distorted since a horizontal deflection magnetic field is generated in a pin-cushion pattern and components of the horizontal deflection magnetic field are generated in a direction of the tube axis. The horizontal deflection magnetic field is generated in the pin-cushion pattern to realize a convergence free system of three electron beams. However, tube-axis direction components are generated by the horizontal deflection magnetic field, and they distort the beam spot. Therefore, if the tube-axis direction components of the horizontal deflection magnetic field can be eliminated, a distortion of the beam spot can be eliminated.

A method of controlling the tube-axis components of the deflection magnetic field is disclosed in Published Japanese Patent Application Nos. 59-173934, 60-146432, 61-188841, 61-288353, 63-207035, and the like. These references describe a method of reducing a tube-axis direction magnetic field by specific shapes of a deflection yoke core and coil, and a method of generating a tube-axis direction magnetic field in the opposite direction by an auxiliary coil. The method of reducing a tube-axis direction magnetic field by specific shapes of a deflection yoke core and coil has a small distortion reduction effect of a beam spot, and the method of generating a tube-axis direction magnetic field in the opposite direction by an auxiliary coil poses problems of a decrease in deflection sensitivity and an increase in cost.

When a convergence offset of three electron beams occurs, color mis-registration occurs, and this also causes deteriorated resolution. For this reason, convergence characteristics are considerably improved by optimal design of a deflection magnetic field distribution.

However, although design of the deflection device is optimized, four quadrants of the screen have different convergence characteristics due to variations of deflection coils, tubes of cathode ray tubes, and electron guns in the manufacture. For example, convergence offsets in the same direction may occur in two quadrants of the screen, and convergence offsets in the opposite direction may occur in the remaining two quadrants. In this state, these convergence offsets cannot be corrected by only adjusting the position of the deflection device with reference to the tube, and must be corrected by mounting a ferromagnetic member such as a ferrite member. With this correction method, however, only offsets on the extreme peripheral portion of the screen can be corrected. Since this correction increases a magnetic flux density, some offsets cannot often be corrected depending on a direction of convergence offset.

In a conventional color cathode ray tube apparatus, a deflection magnetic field control element formed of a ferromagnetic member is arranged on a portion of the electron gun near the screen to correct a coma in convergence, and controls so that deflection magnetic fields having different strengths are applied to a central beam and side beams. Thus, the coma in convergence is corrected, and a vertical deflection magnetic field distribution can be simplified to some extent. However, when the horizontal deflection frequency exceeds 30 kHz, the influence of a residual magnetic flux density of the magnetic field control element is increased, and asymmetrical convergence offsets occur on the right and left portions of the screen, resulting in a degraded image.

As can be seen from the above description, in a home color cathode ray tube apparatus applied to a high-definition TV system such as an EDTV or HDTV, the problems in heat generation of a deflection device, deflection defocus characteristics, variation characteristics of convergence, convergence offsets caused by a deflection magnetic field control element, and the like remain unsolved.

SUMMARY OF THE INVENTION

It is an object of the present invention to provide a color cathode ray tube apparatus which can solve the problems in heat generation of a deflection device, deflection defocus characteristics, variation characteristics of convergence, convergence offsets caused by a deflection magnetic field control element, and the like even in a color cathode ray tube apparatus used in a high-quality image television system, and has a small depth, low power consumption, very high practicability, and high industrial and commercial merits.

A color cathode ray tube apparatus according to the present invention comprises: an envelope having a tube axis, and having a panel, a funnel, and a neck; a screen formed on an inner surface of the panel; an electron gun, accommodated in the neck, for outputting three in-line electron beams; and deflection means, arranged to extend on outer surfaces of the neck and the funnel, for deflecting the electron beams emerging from the electron gun in horizontal and vertical directions.

In this color cathode ray tube apparatus, an outer diameter of the neck having a cylindrical shape is represented by $D_N$, and an interval between adjacent electron beams at a screen-side end portion of the electron gun is represented by Sg, a value of $D_N/Sg$ is 8.0 or more. The deflection means comprises at least a saddle-type horizontal deflection coil for deflecting the electron beams in an in-line direction. The length of the saddle-type horizontal deflection coil along the tube axis is represented by $l_H$all, $l_H$all is 90 mm or more.

In the color cathode ray tube apparatus according to the present invention, since the electron beams pass by positions far from the deflection coil and near the tube axis in a region where the electron beams are deflected, they are not easily influenced by a difference in magnetic field depending on quality of each deflection coil. For this reason, a variation in convergence of electron beams converged on the screen can be reduced, thus improving convergence characteristics. Since the electron beams pass by positions near the tube axis, even if the electron beams are slightly offset from predetermined positions, they are not adversely influenced by the magnetic field. As a result, a variation in convergence can be reduced.

Furthermore, in the color cathode ray tube apparatus according to the present invention, since the length of the deflection coil is larger than that of a conventional coil, tube-axis direction components of a generated magnetic field can be decreased. Therefore, a distortion of a beam spot landing on the screen can be eliminated, and deflection defocus characteristics can be improved. Moreover, since the length of the deflection coil is larger than that of a conventional coil, heat radiation characteristics of the deflection coil can also be improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

A preferred embodiment of the present invention will be described below with reference to the accompanying drawings.

Figure 1:
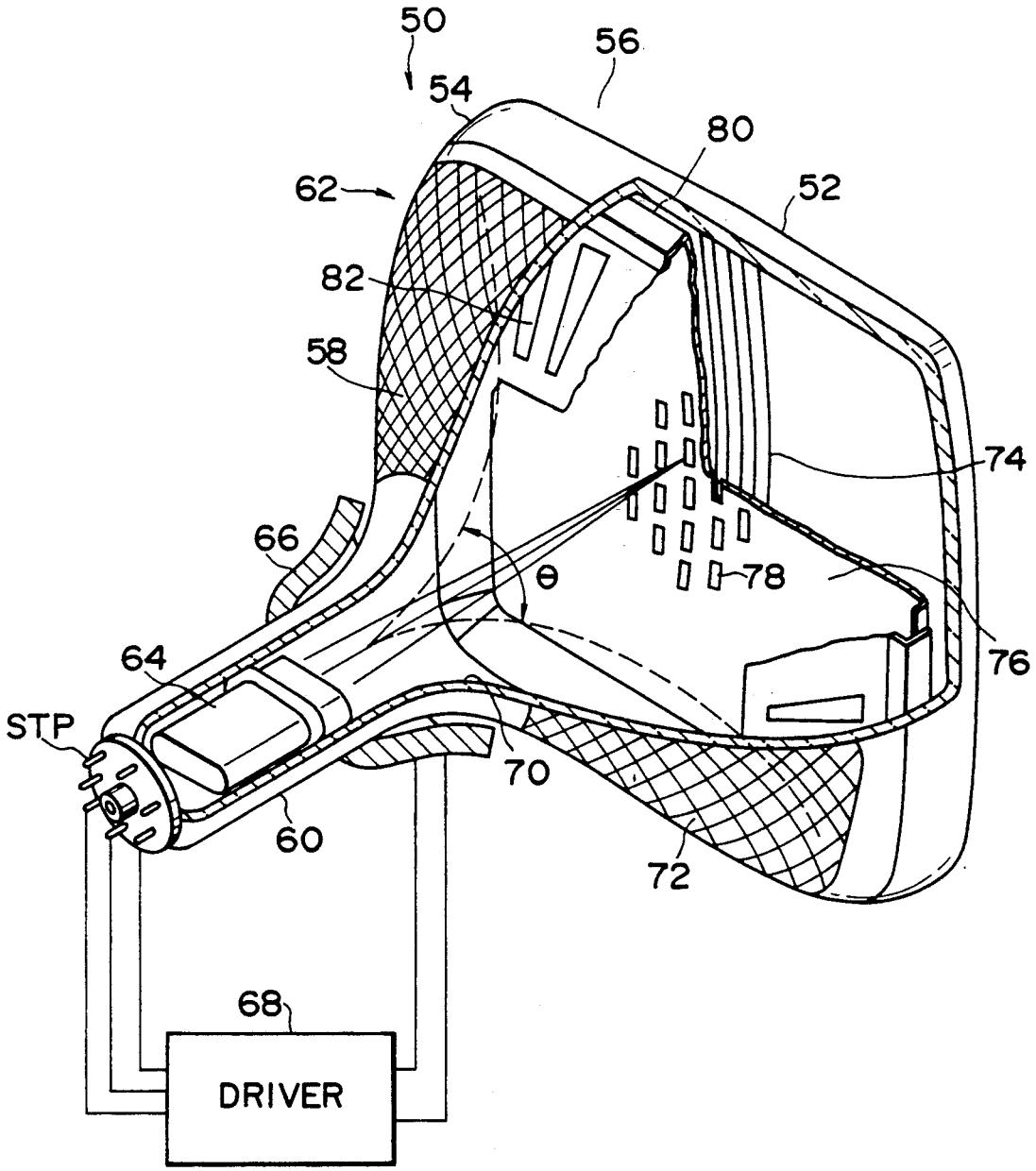
FIG. 1 is a partially cutaway perspective view showing a color cathode ray tube apparatus according to an embodiment of the present invention.

FIG. 1 shows a color cathode ray tube apparatus according to the first embodiment of the present invention. A color cathode ray tube apparatus 50 comprises an envelope 62 which includes a panel section 56 having a substantially rectangular face plate 52 and a skirt 54 extending from a side edge portion of the face plate, a funnel section 58 connected to the panel section 56, and a neck section 60 contiguous with the funnel section. The panel section 56, the funnel section 58, and the neck section 60 maintain a vacuum state of the interior of a tube. An internal conductive film 70 is coated on the inner wall of the funnel section 58, and a portion of the inner wall of the neck section 60 contiguous with the funnel section. An external conductive film 72 is coated on the outer wall of the funnel section 58, and an anode terminal (not shown) is connected thereto. An electron gun assembly 64 for generating three electron beams $B_R$, $B_G$, and $B_B$ is accommodated in the neck section 60. A deflection device 66 having a horizontal deflection coil 67 for generating a magnetic field to deflect the electron beams $B_R$, $B_G$, and $B_B$ in the horizontal direction, and a vertical deflection coil 69 for generating a magnetic field to deflect the beams in the vertical direction is arranged on the outer surfaces of the funnel section 58 and the neck section 60. In order to drive the deflection device 66 and the electron gun assembly 64, a driver 68 for applying an appropriate voltage to the anode terminal connected to the deflection device 66 and stem pins STP connected to the electron gun assembly 64 is connected.

A phosphor screen 74 is formed on the inner surface of the face plate 52 of the panel section 56. A substantially rectangular shadow mask 76 is arranged in the tube to oppose the phosphor screen 74 and to be spaced apart from the face plate 52 by a predetermined interval. The shadow mask 76 is formed of a thin metal plate, and has a large number of apertures 78. A mask frame 80 for supporting the shadow mask 76 is arranged around the shadow mask 76. The mask frame 80 is supported on the panel section 56 through a plurality of elastic support members (not shown). An internal magnetic shield 82 is arranged on the mask frame 80.

The funnel section 58 is formed to have a small depth in consideration of a maximum diagonal deflection angle $\theta$ of 110°. An outer diameter $D_N$ of the neck section 60 is set to be 37.5 mm.

Figure 2:
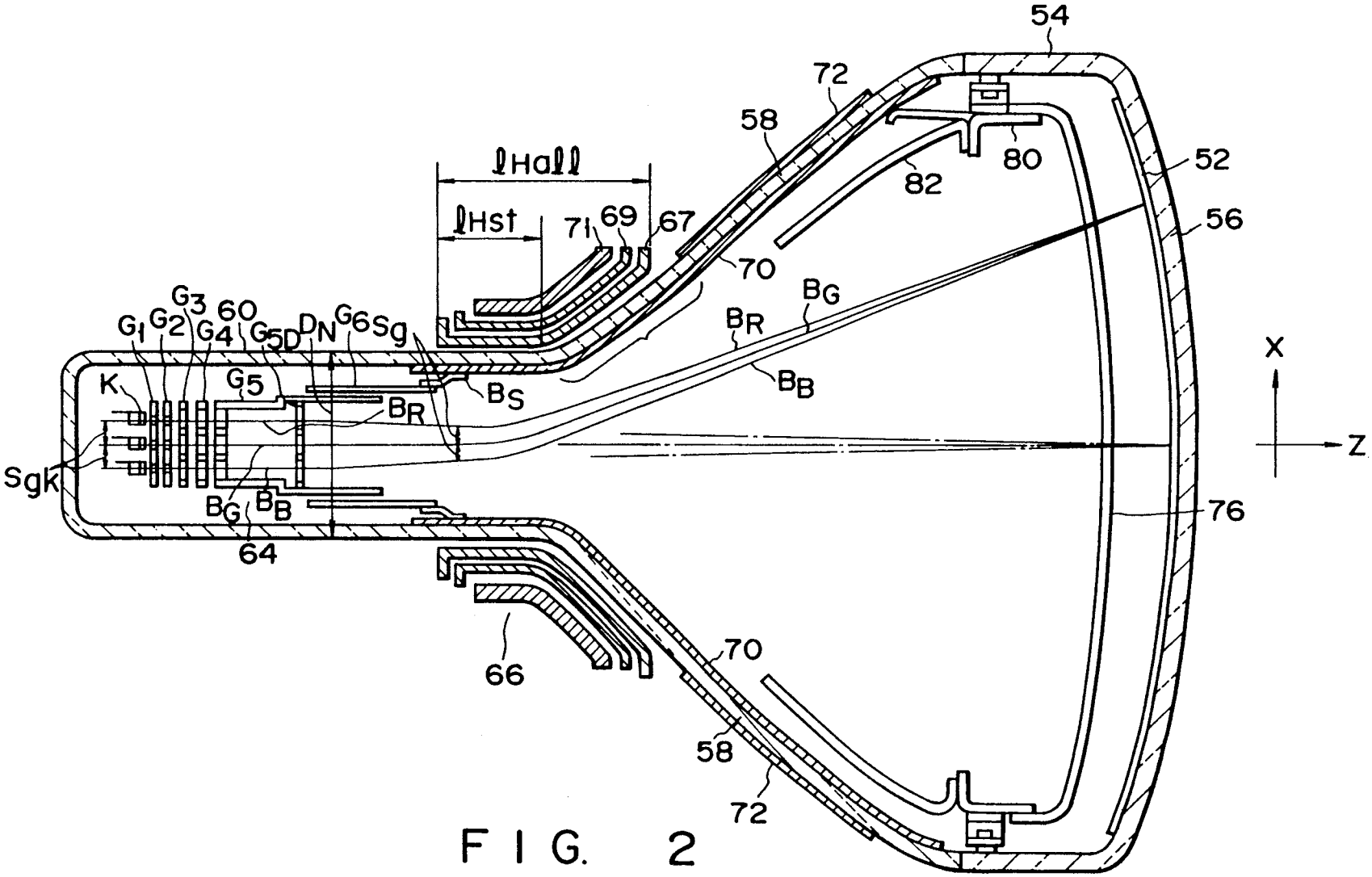
FIG. 2 is a sectional view taken along an X-Z direction of the apparatus shown in FIG. 1.

The electron gun assembly 64 accommodated in the neck section 60 will be described below with reference to FIG. 2. The electron gun assembly 64 comprises cathodes K for generating electron beams, first and second grids $G_1$ and $G_2$ for forming electron beams, third to sixth grids $G_3$, $G_4$, $G_5$, and $G_6$ for focusing the electron beams, an insulating support member (not shown) for supporting these grids, and a bulb spacer BS. The electron gun assembly 64 is fixed by stem pins STP.

Electrodes excluding the sixth grid $G_6$ are applied with an external voltage via the stem pins STP. For example, the cathodes K are applied with a cutoff voltage of about 150 V, the first grid $G_1$ is used as a ground terminal, the second grid $G_2$ is applied with a voltage of 500 V to 1 kV, the third and fifth grids $G_3$ and $G_5$ are applied with a voltage of 5 to 10 kV, the fourth grid $G_4$ is applied to a voltage of 0 to 3 kV, and the sixth grid $G_6$ is applied with a high anode voltage of 25 to 35 kV.

The cathodes K generate three electron beams $B_R$, $G_B$, and $B_B$. The three electron beams $B_R$, $B_G$, and $B_B$ become incident in the first grid $G_1$. The electron beams $B_R$, $B_G$, and $B_B$ are formed and accelerated when they pass through the first, second, and third grids $G_1$, $G_2$, and $G_3$. An interval Sg between the central beam $B_G$ and the side beam $B_R$ or $B_B$ is set to be 4.92 mm to improve convergence characteristics. The electron beams $B_R$, $B_G$, and $B_B$ are weakly focused by unipotential lenses formed by the third, fourth, and fifth grids $G_3$, $G_4$, and $G_5$, and the central axes of the electron beams are kept parallel to each other. Thereafter, the electron beams $B_R$, $B_G$, and $B_B$ become incident on a large-aperture electron lens formed by the fifth and sixth grids $G_5$ and $G_6$. The large-aperture electron lens commonly influences the electron beams $B_R$, $B_G$, and $B_B$, and converges and focuses them on the screen. The large-aperture electron lens has an auxiliary electrode $G_5D$ having three beam passage holes in the fifth grid $G_5$. The electrode $G_5D$ controls a low-voltage side magnetic field of the large-aperture electron lens to optimally converge and focus the electron beams.

Since the paths of the electron beams $B_R$, $B_G$, and $B_B$ are deflected by the large-aperture electron lens to be converged on the screen, the beam interval Sg at the screen-side end portion of the electron gun is about 4.0 mm. This value is smaller than a beam interval Sgk between the cathodes K to the fourth grid $G_4$.

The horizontal deflection coil 67 of the deflection yoke 66 is molded into a saddle shape, and the vertical deflection coil 69 also has a saddle shape. The deflection coils 67 and 69 are molded into shapes along the funnel and neck sections to decrease an average diameter and to increase a deflection sensitivity. The deflection coils 67 and 69 are wound to be substantially parallel to the tube axis. The deflection coils 67 and 69 are wound along the funnel section near the screen. A total length $l_H$all of the horizontal deflection coil in the direction of the tube axis is 105 mm, and a length $l_H$st of a coil portion wound to be substantially parallel to the tube axis is 40 mm. Both $l_H$all and $l_H$st of the horizontal deflection coil of this embodiment are larger than those of a conventional deflection coil used in 110° deflection.

With this structure, according to this embodiment, a ratio $D_N$/Sg of the neck outer diameter $D_N$ to the beam interval Sg is 9.4.

Characteristics of this embodiment will be described below.

In convergence characteristics of this embodiment, if the tube axis of the tube is represented by a Z-axis, an in-line direction of the electron beams is represented by an X-axis, and a direction perpendicular to the in-line direction is represented by a Y-axis, and four portions of the screen divided by the X- and Y-axes are defined as four quadrants, an average of maximum mis-convergence amounts in the four quadrants is 0.4 mm, and a maximum variation amount in the four quadrants is 0.3 mm, that is, good results can be obtained. On the other hand, in a conventional 32" 110° deflection color cathode ray tube apparatus ($D_N$=32.5 mm, Sg=6.2 mm, $l_H$all=82 mm, $l_H$st=15 nm, $D_N$/Sg=5.2), an average of maximum mis-convergence amounts is about 1.5 mm, and a maximum variation amount in the four quadrants is 1.0 mm.

Figure 3:
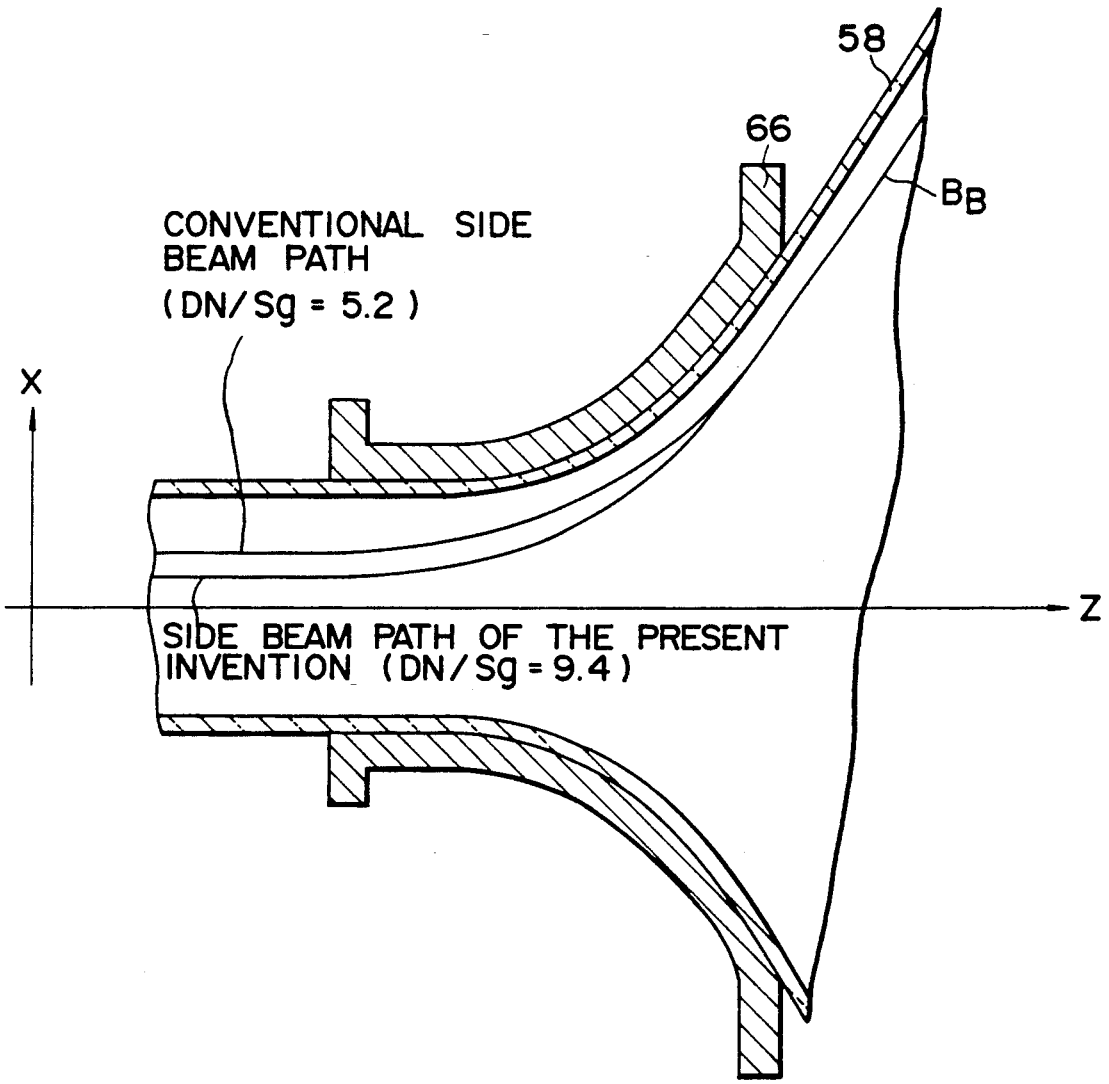
FIG. 3 is an enlarged sectional view taken along an X-Z direction of a portion of the apparatus shown in FIG. 1 near a deflection yoke.
Figure 4:
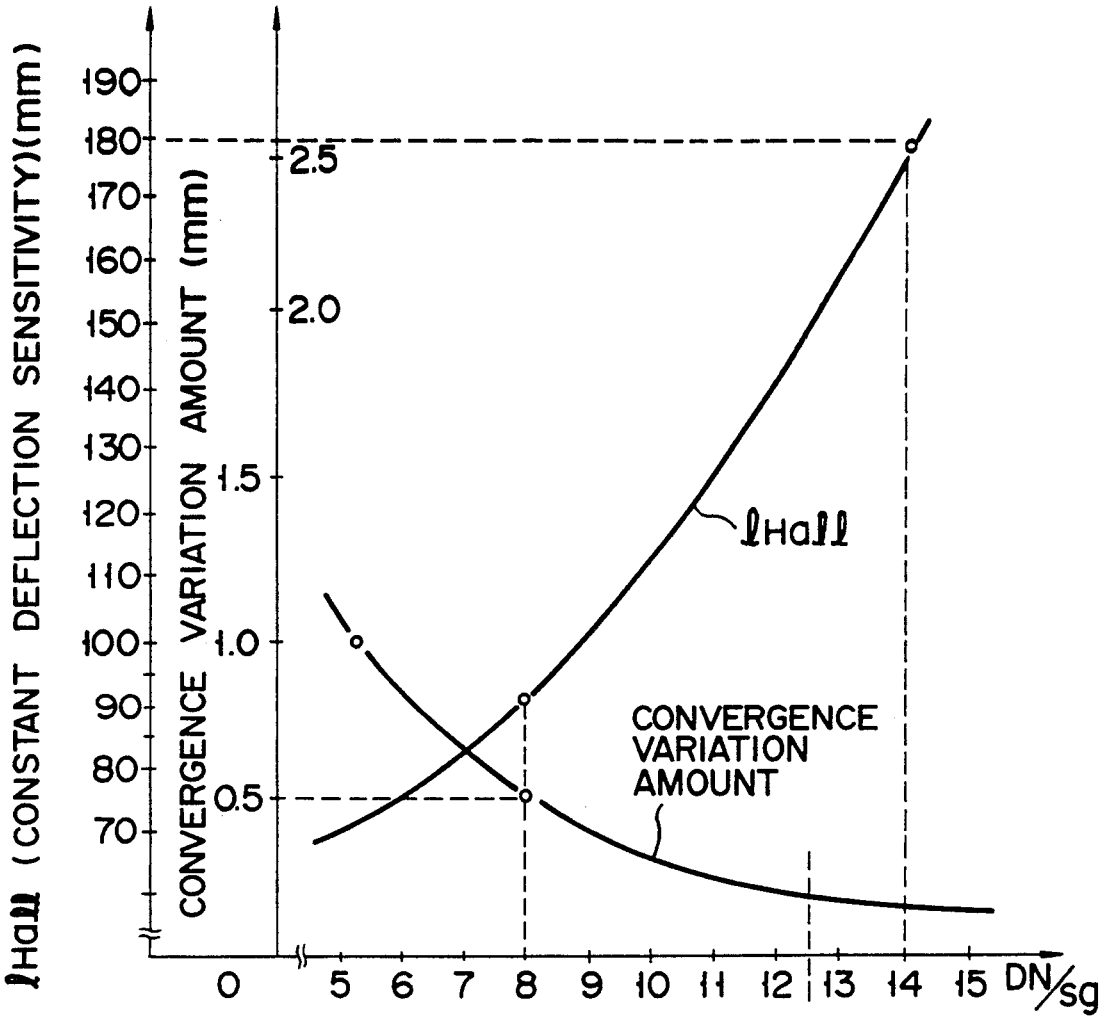
FIG. 4 is a graph showing a relationship in which the length of the deflection yoke or the convergence variation amount is plotted along the ordinate, and a value $D_N/Sg$ is plotted along the abscissa.

The average value of maximum mis-convergence amounts in the four quadrants of the screen can be improved since Sg is small and a deflection magnetic field distribution is optimized. The maximum variation amount in the four quadrants of the screen can be improved for the following reasons. A ratio of the neck outer diameter $D_N$ to the interval Sg between the central beam and each of the two side beams becomes large, and the electron beams can pass a relatively central portion of the deflection magnetic field, as shown in FIG. 3, so that the influence of an axis offset between the deflection coils and the cathode ray tube can be minimized. FIG. 4 shows the relationship between the maximum variation amount and $D_N$/Sg in the four quadrants of the screen. As can be understood from FIG. 4, when $D_N$/Sg is increased, a variation in mis-convergence amount can be eliminated. In this case, since a maximum variation amount must be decreased below 0.5 mm in a system for an EDTV, the value $D_N$/Sg is preferably set to be 8.0 or more.

In the present invention, no magnetic field control element for controlling a deflection magnetic field with different strengths for the central electron beam and the two side electron beams is used, and a coma in convergence is prevented by optimal design of a deflection magnetic field distribution of the deflection yoke. For this reason, if the horizontal deflection frequency is set to be 30 kHz or higher, no asymmetrical convergence offsets occur on the right and left portions of the screen, and a good image can be obtained. In addition, since no magnetic field control element is used, a coma of the electron beam spot can be eliminated, thus obtaining a better image on the peripheral portion of the screen.

Deflection defocus characteristics of this embodiment will be described below. In this embodiment, since the length of the horizontal deflection coil is set to be as large as 105 mm, tube-axis direction components of the horizontal deflection magnetic field can be eliminated.

Figure 5A:
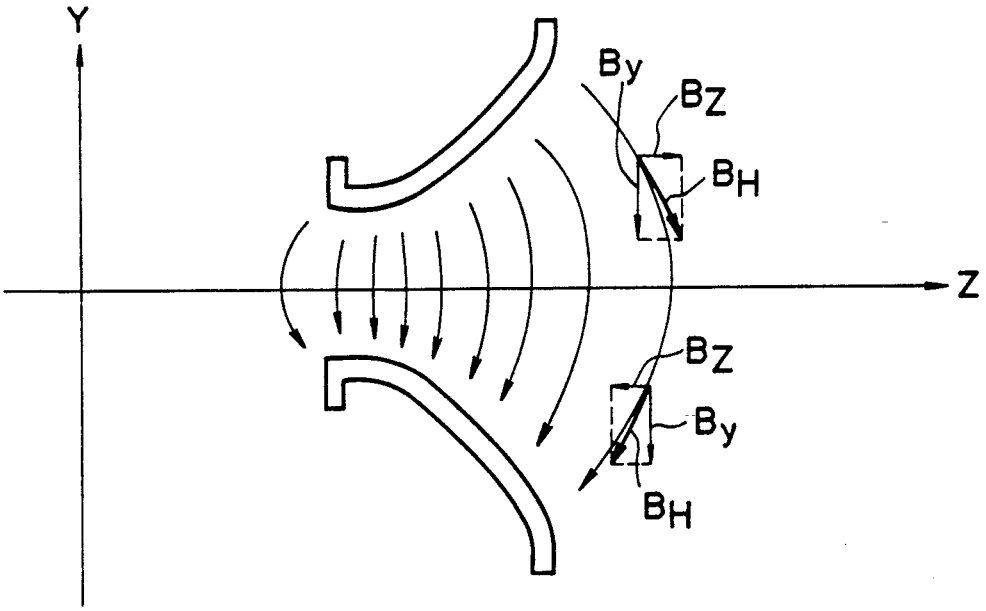
FIGS. 5A and 5B are sectional views showing states of magnetic fields of a conventional deflection device and a deflection device according to the present invention.
Figure 6A:
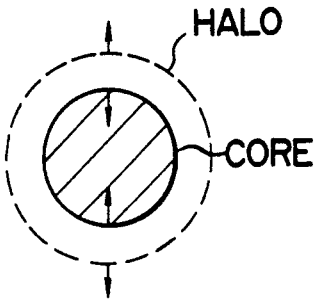
FIGS. 6A, 6B, and 6C respectively show a normal electron beam pattern, a conventional electron beam pattern deformed by a deflection device, and electron beam patterns of the present invention.
Figure 6B:
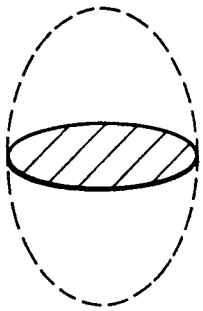

In a conventional deflection yoke, as shown in FIG. 5A, a horizontal deflection magnetic field $B_H$ is curved near the front end portion of the deflection yoke, and generates large tube-axis direction components $B_Z$. As shown in FIG. 6A, electron beams be deflected in the horizontal direction receive a force in a direction to be squeezed in the vertical direction by the tube-axis direction components $B_Z$, and are distorted in the horizontal edges and diagonal edges of the screen, as shown in FIG. 6B. In each of FIGS. 6A to 6C, a solid curve represents an electron beam near the center, a dotted curve represents an electron beam near a peripheral portion, and they correspond to a core and a halo on the screen.

Figure 5B:
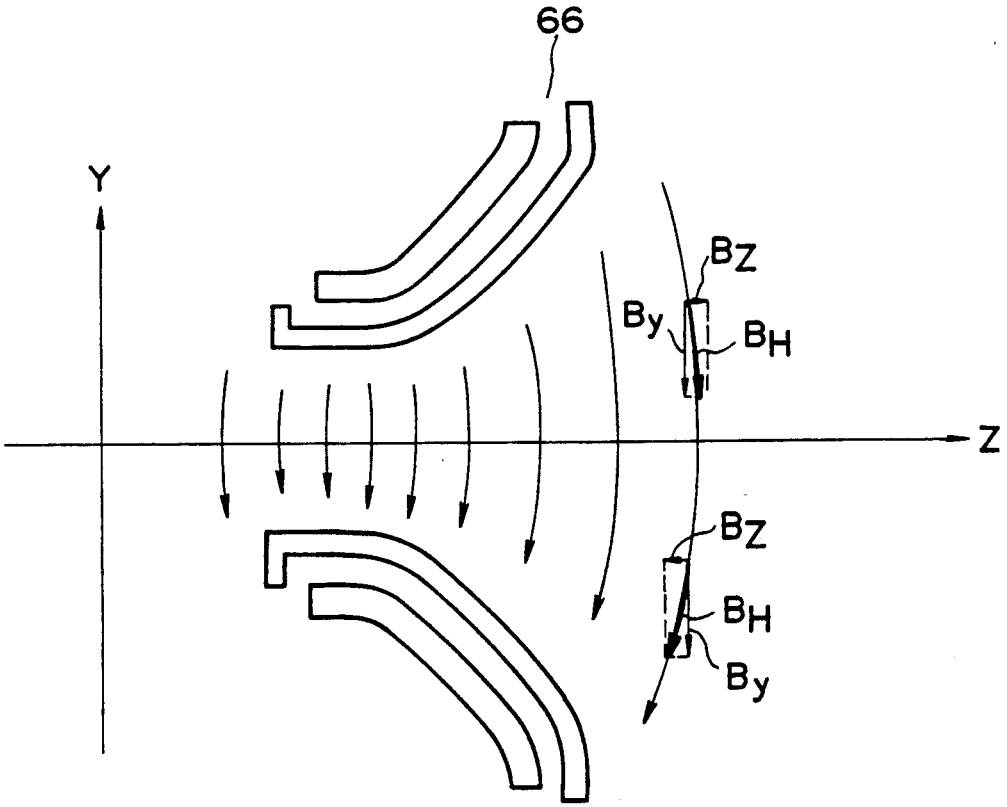

A cause for generating the large tube-axis direction magnetic field components $B_Z$ lies in the fact that a region in the direction of the tube axis where the deflection magnetic field is generated is short. According to the present invention, since the length of the horizontal deflection coil is increased to prolong a region where the deflection magnetic field is generated, the tube-axis direction magnetic field components $B_Z$ can be eliminated, as shown in FIG. 5B.

Figure 6C:
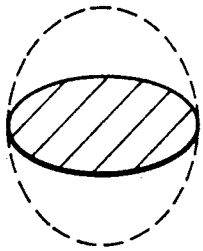

In this embodiment, a vertical diameter of the halo can be improved by about 40% as compared to a conventional color cathode ray tube, and a distortion of a beam spot caused by the deflection device can be greatly improved, as shown in FIG. 6C. Thus, when the dynamic focus method is hot employed, a resolution on the peripheral portion of the screen can be greatly improved. When the dynamic focus method is employed, a change amount of a dynamic focus voltage can be decreased from 1 to 2 kV (conventional device) to about 500 V to 1 kV. Thus, cost of a television set can be reduced. In this manner, the deflection defocus characteristics are improved by increasing the length of the horizontal deflection coil. In this embodiment, since the horizontal deflection coil is extended mainly toward the electron gun side to increase the coil length, the deflection defocus characteristics can be improved without impairing a deflection sensitivity. Since $D_N/Sg$ of this embodiment is 9.4, i.e., is larger than that of a conventional color cathode ray tube, a spatial margin between the neck section and passage positions of the two side electron beams can be increased, as shown in FIG. 3, and the deflection coil can be prolonged toward the electron gun without causing a neck shadow phenomenon. FIG. 4 shows the relationship between $D_N/Sg$ and the length $l_H$all of the horizontal deflection coil in the direction of the tube axis when the deflection coil is prolonged without impairing the deflection sensitivity. As described above, in order to decrease a variation amount of convergence below 0.5 mm, $D_N/Sg > 8.0$ must be satisfied. At this time, $l_H$all > 90 mm is preferably satisfied in terms of a deflection distortion of a spot.

In this manner, the length $l_H$all of the horizontal deflection coil is preferably set to be 90 mm or more. However, this can be attained by prolonging the neck section of the cathode ray tube, and as a result, the total length of the cathode ray tube is increased. Therefore, if the length $l_H$all of the horizontal deflection coil is too large, the total length of the cathode ray tube is increased, and a small depth as a merit, i.e., a merit of wide-angle deflection of 100 to 110° is lost. For this reason, in wide-angle deflection cathode ray tubes having screen diagonal diameters of 25" to 40", the length $l_H$all of the horizontal deflection coil must be 180 mm or less in consideration of the total length of the cathode ray tube. If the length $l_H$all is further increased, the cathode ray tube undesirably has a large depth, and is not suitable for a home use. Therefore, in a large-size, wide-angle deflection cathode ray tube, the length $l_H$all of the horizontal deflection coil is preferably set to fall within a range of 90 mm to 180 mm, and a value $D_H/Sg$ corresponding to this range falls within a range of 8.0 to 14.0, as can be seen from FIG. 4.

Temperature characteristics of the deflection device according to the present invention will be described below. In this embodiment, as described above, since a large deflection coil is employed without impairing deflection sensitivity, a heat radiation amount of the deflection yoke is increased, thus improving temperature characteristics. Thus, in the case wherein an anode voltage is 32 kV, a horizontal deflection frequency is 33.8 kHz, 110% scanning is performed, and a special wire such as a litz wire is not used, a temperature can be 45° C. or less. In a conventional color cathode ray tube, the temperature is 50° C. or more under the same conditions, and a special wire such as a litz wire must be used, resulting in a considerable increase in cost. When the horizontal deflection frequency is set at 64 kHz to improve image quality, the temperature of the conventional color cathode ray tube becomes 70° C. or more even if a litz wire is used, and the apparatus cannot be used. According to the present invention, when a litz wire is used, the temperature can be suppressed below 60° C. even in scanning at 64 kHz. Therefore, such an improvement of image quality can be attained, and a high-quality image can be obtained.

As described above, the color cathode ray tube apparatus according to the present invention can obtain very good convergence, deflection defocus, and temperature characteristics of the deflection device. In addition, a 110° deflection apparatus having a small depth can be realized, and cost including that of a television set can be reduced. Therefore, the color cathode ray tube apparatus of the present invention can provide a high-quality image with low cost as a home television cathode ray tube which can be applied to high-frequency deflection and high-quality image broadcast such as an EDTV and HDTV.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube apparatus comprising:

an envelope having a tube axis and having a panel, a funnel, and a neck;

a screen formed on an inner surface of said panel;

an electron gun, accommodated in said neck, for outputting three in-line electron beams; and deflection means, arranged to extend on outer surfaces of said neck and said funnel, for deflecting the electron beams emerging from said electron gun in horizontal and vertical directions, wherein an outer diameter of said neck having a cylindrical shape is represented by $D_N$ and an interval of adjacent electron beams at a screen-side end portion of said electron gun is represented by Sg, a value $D_N/Sg$ is not less than 8.0, and said deflection means comprises a saddle-type horizontal deflection coil for deflecting the electron beams in an in-line direction, and if a length of said saddle-type horizontal deflection coil in a direction of the tube axis is represented by $l_H$all, $l_H$all is not less than 90 mm.

2. An apparatus according to claim 1, wherein said horizontal deflection coil is molded to have $l_H$all of not more than 180 mm.

3. An apparatus according to claim 1, wherein the value $D_N/Sg$ is not more than 14.0.

4. An apparatus according to claim 1, wherein said deflection means comprises a saddle-type vertical deflection coil.

5. An apparatus according to claim 1, wherein said horizontal deflection coil has a portion substantially parallel to the tube axis, which portion has a length $l_H$st of 40 mm.

6. An apparatus according to claim 1, wherein $l_H$all of said horizontal deflection coil is 105 mm.

* * * * *